United States Patent [19]

Shinsei et al.

[11] Patent Number: 4,622,810

[45] Date of Patent: Nov. 18, 1986

[54] DEVICE FOR REMOVING PARTICULATES IN EXHAUST GAS

[75] Inventors: Kiyoichi Shinsei, Ono; Hiroaki Takada, Himeji, both of Japan

[73] Assignee: Mitsubishi Denki Kabushiki Kaisha, Tokyo, Japan

[21] Appl. No.: 810,906

[22] Filed: Dec. 20, 1985

Related U.S. Application Data

[63] Continuation of Ser. No. 548,873, Nov. 4, 1983, abandoned.

[30] Foreign Application Priority Data

Nov. 16, 1982 [JP] Japan ..... 57-174359[U]

[51] Int. Cl.[4] ..... F01N 3/02

[52] U.S. Cl. ..... 60/286; 55/283; 55/466; 55/DIG. 30; 60/303; 60/311

[58] Field of Search ..... 60/286, 303, 311; 55/466, 283, DIG. 30

[56] References Cited

U.S. PATENT DOCUMENTS

| | | | |
|---|---|---|---|
| 4,281,512 | 8/1981 | Mills | 55/466 |
| 4,335,574 | 6/1982 | Sato | 55/466 |
| 4,345,431 | 8/1982 | Suzuki | 55/283 |

OTHER PUBLICATIONS

W. R. Wade et al., "Diesel Particulate Trap Regeneration Techniques", SAE Technical Paper 810118, Int'l Conf., Feb. 1981, Society of Automotive Engineers, Inc., pp. 16–21.

O. A. Ludecke et al., "Diesel Exhaust Particulate Control System Development", SAE Technical Paper 830085, Int'l Conf., Feb. 1983, Society of Automotive Engineers, Inc., pp. 19–21.

*Primary Examiner*—Douglas Hart

*Attorney, Agent, or Firm*—Wenderoth, Lind & Ponack

[57] ABSTRACT

A particulate removing device comprises a regenerating burner connected via an interrupting valve to a mixer subsequently connected to a particulate filter. The interrupting valve may be disposed in a housing for the burner on that end portion connected to the mixer through an exit to open and close the exit. When the burner generates a combustion gas, the valve opens the exit to permit the combustion gas to enter the mixer where it is mixed with an exhaust gas from a Diesel engine. The mixed gas heats and regenerates the particulate filter. When the burner is not used, the valve closes the exit to prevent the exhaust gas from the mixer from partly entering the burners housing. Alternatively, the interrupting valve may be disposed in a housing for the mixer on that end portion connected to the burner's housing through an exit to open and close the inlet.

6 Claims, 7 Drawing Figures

DEVICE FOR REMOVING PARTICULATES IN EXHAUST GAS

This application is a continuation of now abandoned application Ser. No. 548,873, filed Nov. 4, 1983, now abandoned.

BACKGROUND OF THE INVENTION

This invention relates to a device for removing particulates existing in an exhaust gas from a Diesel engine, and more particularly to a highly efficient regenerative of particulate filter included in such a device.

At the present time devices of the type referred to do not exist but are awaited to be developed in view of the following background: Since it is feared particulates contained in the exhaust gas from Diesel engines impede the health of the human body, there is a tendency to regulate the amount of particulates exhausted from Diesel engines and indeed such regulation has been promulgated by the federal government of the United States of America.

The amount of exhausted particulates can be reduced by either of two different methods, one or which is designed to improve the Diesel engines themselves to reduce the amount of particulates exhausted therefrom, and the other of which is designed to filter out the particulates. The one method is ideal but it can be expected only to reduce the particulates to a limited extent under the present circumstances. Thus, if particulate exhaust regulations become strict in the future, this method may be impossible to carry out. The other method is to filter out the particulates as by a ceramic filter in the form of a honeycomb disposed on an exhaust gas system for an associated Diesel engine. The latter method is most effective although it has the disadvantage that the filter must be regenerated when meshes thereof have become clogged.

The clogged filter can be regenerated in accordance with the following principles: The particulates adhering to the filter are principally formed of carbon and catch fire at a temperature on the order of 550° C. Thus, when the exhaust gas from Diesel engine is heated at a temperature of not less than 550° C., particulates contained in the exhaust gas change to carbon dioxide resulting in the regeneration of the filter. However, a problem arises when the temperature of the exhaust gas is only raised to a temperature less than 550° C.

During the normal travel of vehicles equipped with the Diesel engine, the exhaust gas therefrom has a temperature of at most about 400° C. and therefore cannot regenerate the associated filter. Therefore, it is required to regenerate the filter by adding to the exhaust system for Diesel engines a heater for heating the exhaust gas from the associated Diesel engines. That heater forms a device for regenerating the filter. For example, the particulate filter may be regenerated by raising the temperature of the exhaust gas through the throttling of air supplied to the Diesel engines or by using a regenerating burner. Under the present circumstances, the use of the regenerating burner is effective but a problem is encountered in that, when the regenerating burner is not being used, or in the operation of the Diesel engine with the filter for filtering out the particulates in an associated exhaust gas not being regenerated, exhaust gas containing a large amount of the particulates intrudes into a region of the regenerating burner which includes an injection nozzle for injecting a fuel and air mixture and an associated ignition plug, to cause the particulates to adhere to a small hole in the nozzle and an electrically insulating portion of the ignition plug, thereby to bring about clogging of the nozzle hole and misfiring of the ignition plug. This results in objections such as that the filter regenerating device becomes impossible to be operated. Thus, it is required to prevent the particulates in the exhaust gas from entering the regenerating burner.

Accordingly, it an object of the present invention to provide a device for removing particulates in an exhaust gas from an associated Diesel engine with a new and improved filter regenerating device, including a regenerating burner to regenerate a particulate filter and means for preventing the regenerating burner from being exposed to the exhaust gas when the burner is not used during operating of the Diesel engine.

SUMMARY OF THE INVENTION

The present invention provides a device for removing particulates in an exhaust gas from a Diesel engine, comprising a particulate filter disposed in an exhaust tube from a Diesel engine to catch particulates existing in an exhaust gas from the Diesel engine, a regenerating burner disposed to be put in fluid communication with the exhaust tube to burn and remove the particulates caught by the particulate filter, a burner control means for controlling the regenerating burner, and an interrupting valve disposed on a portion of the exhaust tube put in fluid communication with the regenerating burner to be responsive to non-use of the regenerating burner to interrupt fluid communication of the regenerating burner with the exhaust tube so as to prevent the exhaust gas from going around to the regenerating burner.

In a preferred embodiment of the present invention, the regenerating burner includes a housing having one end closed and the other end open to form a combustion chamber, an injection nozzle disposed on the closed end portion of the housing to inject a fuel and air mixture into the interior of the housing, and an ingition plug disposed on the closed end portion of the housing to be adjacent to the injection nozzle, and the interrupting valve is disposed on the open end portion of the housing connected to the mixer to open and close an exit for the combustion gas disposed on the open end of the housing.

In another preferred embodiment of the present invention a mixer is connected to the exhaust tube upstream of the particulate filter to mix the exhaust gas with a combustion gas generated by the regenerating burner and includes a housing open at both ends, one of which is connected to the particulate filter and the other of which forms an inlet for the combustion gas generated by the regenerating burner, and the interrupting valve is disposed to open and close the inlet for the combustion gas.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
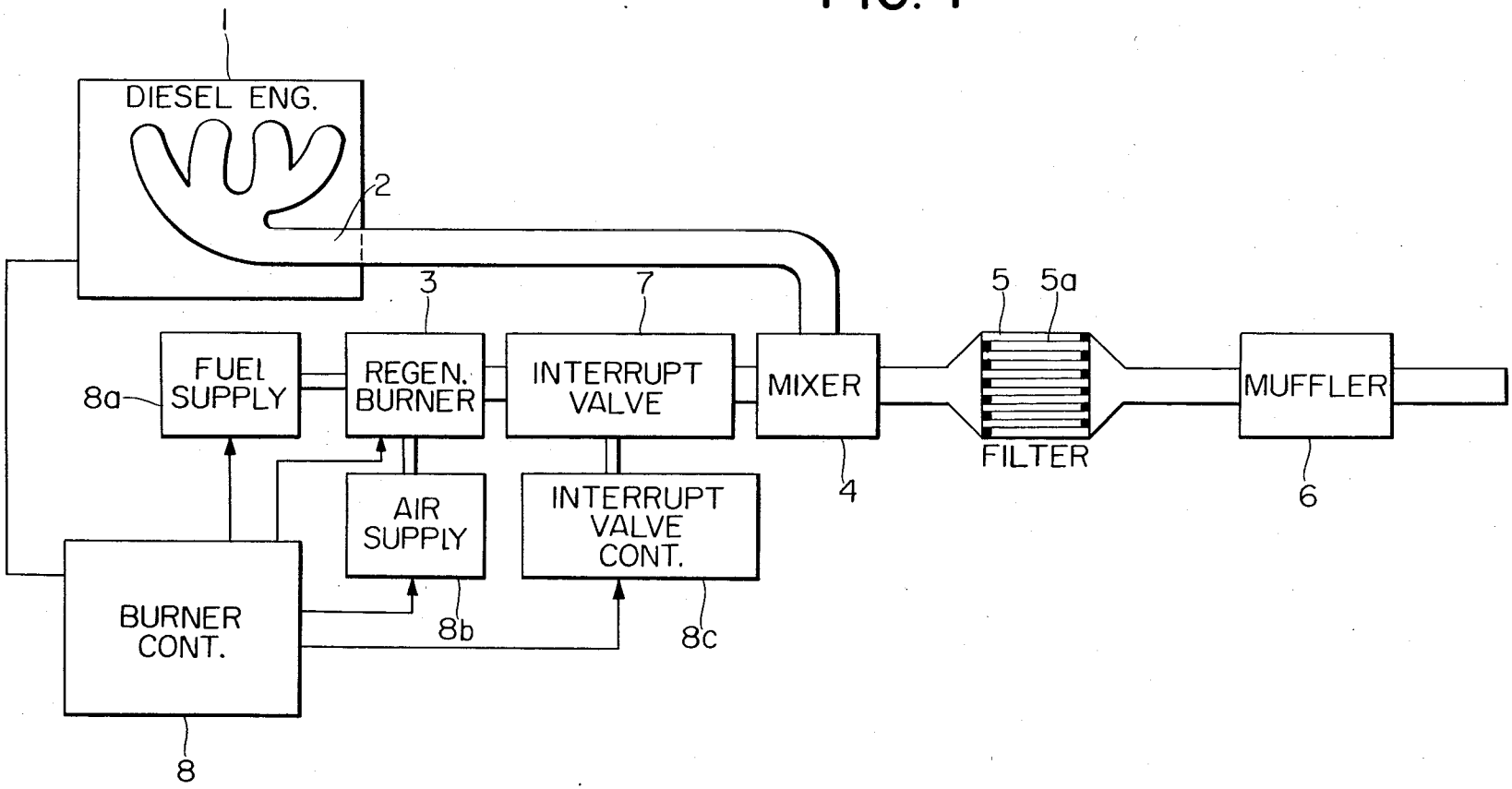
FIG. 1 is a block diagram of one embodiment according to the particulate removing device of the present invention.

Referring now to FIG. 1 of the drawings, there is illustrated in a block diagram one embodiment according to the particulate removing device of the present invention. The arrangement illustrated comprises a Diesel engine 1, an exhaust tube 2 from the Diesel engine 1 extending to the exterior of the latter, a regenerating burner 3, a mixer 4 connected to the exhaust tube 2 and also to a filter housing 5 including a plurality of particulate filters 5*a*, and a muffler 6 connected to the filter housing 5. The regenerating burner 3 is connected to the mixer 4 through an interrupting valve 7 for opening and closing a fluid communication passageway extending between the regenerating burner 3 and the mixer 4. The mixer 4 is in a conduit connected to the inlet of the filter housing 5. The mixer 4 is operative to mix an exhaust gas from the Diesel engine 1 with a combustion gas generated by the regenerating burner 3.

A burner control 8 receives signals concerning the operation of the Diesel engine 1 and delivers output signals to a fuel supply device 8*a* for supplying a light oil to the burner 3, an air supply device 8*b* for supplying air to the burner 3, and an interrupting valve control 8*c*.

The operation of the arrangement shown in FIG. 1 will now be described. During the normal operation of the Diesel engine 1 or when the particulate filters 5*a* are not being regenerated, the exhaust gas from the Diesel engine 1 is passed through the exhaust tube 2, the mixer 4 and the particulate filters 5*a* within the filter housing 5 and then exhausted to the atmosphere through the muffler 6.

Under these circumstances, particulates contained in the exhaust gas are filtered out by the particulate filters 5*a* to adhere to the latter. Upon an increase in amount of the particulates adhering to each of the particulate filters 5*a*, the latter increases in pressure loss resulting in an increase in fuel usage of the Diesel engine relative to the travel distance of an associated vehicle. Thus, when an increased amount of particulates adhering to the filters 5*a* is sensed, the regenerating burner 3 burns the light oil under the control of the burner control 8, and therefore the fuel supply device 8*a* and the air supply device 8*b*, to produce a hot combustion gas. The hot combustion gas passes through the interrupting valve 7 opened by the interrupting valve control 8*c* and then enters the mixer 4 where the gas is mixed to the exhaust gas to form a hot mixed gas. Then the combustion gas and the heated exhaust gas enter the filter housing 5 to heat and regenerate the particulate filters 5*a*.

In the absence of the interrupting valve 7, part of the exhausted gas flows into the regenerating burner while not in use with the result that particulates contained in that part of the exhaust gas adhere in large amount to the inner wall surface of the burner 3 including a nozzle portion thereof and an associated ignition plug to cause the clogging of a nozzle's hole, misfire of the ignition plug and other problems.

In the present invention, however, the presence of the interrupting valve 7 ensures that the exhaust gas is prevented from partly entering the regenerating burner 3. This prevents the clogging of the nozzle's hole, the misfire of the ignition plug, etc., as described above.

The interrupting valve 7 may be assembled integrally with the regenerating burner 3 or the mixer 4. This measure permits assembly to be effected without an increase in the number of the components and without any complication.

Figure 2A:
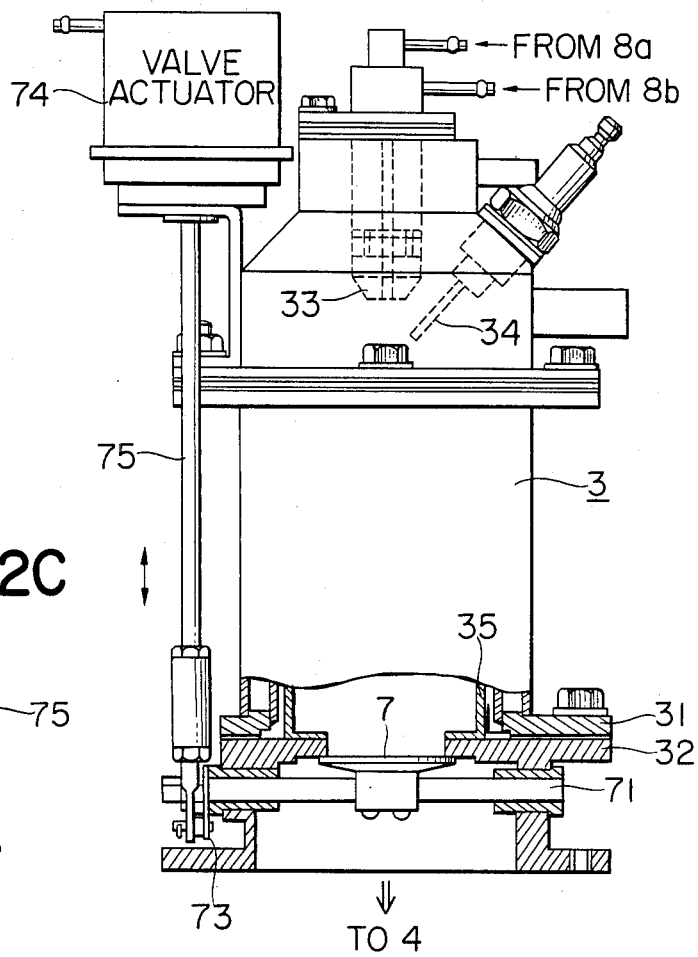
FIG. 2A is a front elevational view of the regenerating burner, the interrupting valve and the interrupting valve control shown in FIG. 1 and connected together into an unitary structure with parts illustrated in section.

FIG. 2A shows a regenerating burner unit of the particulate removing device of the present invention, including the interrupting valve 7 integrally assembled with the regenerating burner 3. The arrangement illustrated comprises the regenerating burner 3 including a combustion housing 31 in the form of a hollow cylinder including one end portion, in this case the upper end portion as viewed FIG. 2A reduced in diameter and closed, and an other or lower end open, and an interrupting valve housing 32 in the form of a hollow short cylinder open at both ends and fixedly connected to the lower end of the combustion housing 31 through bolts and nuts to be coaxial with the latter.

Disposed within the combustion housing 31 are an injection nozzle 33 fixed on the upper closed portion of the housing 31 on the longitudinal axis and an ignition plug 34 fixed on the upper closed portion of the housing 32 to be tilted to the longitudinal axis thereof and adjacent to the extremity of the injection nozzle 33. The injection nozzle 33 is connected to the fuel supply device 8*a* and the air supply device 8*b* (see FIG. 1) through respective connecting tubes to inject a fuel and air mixture into the interior of the combustion housing 31 and the ignition plug 34 is arranged to catch the fuel and air mixture on fire from an electric spark discharge. An internal combustion member 35 in the form of a hollow cylinder is disposed coaxially within the combustion housing 31 to form an annular spacing therebetween. The internal combustion cylinder 35 serves to prevent the inner wall of the housing 31 from directly touching the electric spark or to be exposed to an elevated temperature.

The interrupting valve housing 32 is provided on one of the open ends, in this case, the upper open end as viewed in FIG. 2A with an apertured end plate bolted to an annular plate on which the combustion housing 31 is fixed and on the other or lower end with a radially outward directed flange adapted to be connected to the mixer 4 (see FIG. 1). The apertured end plate includes a circular aperture for forming an exit for a combustion gas generated by the regenerating burner 33 on the longitudinal axis of the combustion housing 31, and also serves as a valve seat for the interrupting valve for opening and closing the exit for the combustion gas.

Figure 2C:
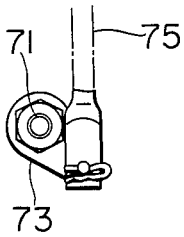
FIG. 2C is a perspective view in a somewhat enlarged scale of one part of the arrangement shown in FIG. 2A.
Figure 2B:
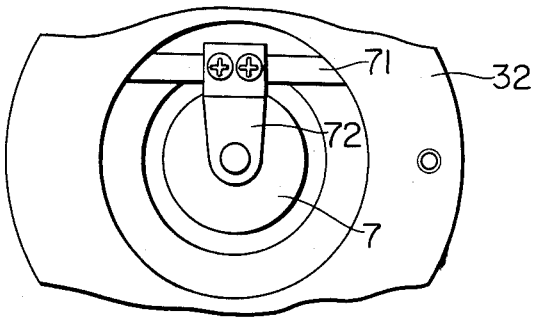
FIG. 2B is a fragmental bottom plan view of the arrangement shown in FIG. 2A.

The interrupting valve 7 is circular as illustrated in FIG. 2B, and shown in FIG. 2A as contacting the lower side of the valve seat to close the exit for the combustion gas. A rotatable rod 71 is rotatably supported by a peripheral wall of the valve housing 32 below the apertured plate to extend along a diameter thereof and fixedly connected to the interrupting valve through a mounting strip 72 fixedly screwed at one end on the rotatable rod 71 and perpendicular thereto, and at the other end on the central portion of the interrupting valve 7, as shown in FIG. 2B. The rotatable rod 71 includes one end portion, in this case, the lefthand end portion as viewed in FIG. 2A extending a short distance outside of the valve housing 32. A rotatable plate 73 is fixed to the extended portion of the rotatable rod 71 by bolt and nut means.

A valve actuator 74 is disposed adjacent to the upper portion of the combustion housing 31 outside thereof by having a bracket in the shape of a U located sideways and including one leg fixed to the lower portion of the valve actuator 74 and the other leg suitably bolted to the adjacent portion of the peripheral wall of the housing 31, and a receprocatable rod 75 extending downward from the lower end of the valve actuator 74 to be parallel to the common longitudinal axis of the housings 31 and 32 and having the lower end as viewed in FIG. 2A bolted to the rotatable plate 73 at a position thereof deviating from of the center of rotation of the rotatable rod 75 as shown in FIGS. 2B and 2C.

The actuator 74 is connected to the interrupting valve control 8*c* (see FIG. 1) to be operated in response to a negative pressure signal delivered from the interrupting valve control 8*c* due to a control signal from the burner control 8 (see FIG. 1) to move the rod 75 in reciprocating manner as shown by the double arrow denoted beside the rod 75 to selectively rotate the rod 71 in one and the other of two directions of rotation thereby to selectively open and close the interrupting valve 7. Thus, the valve actuator 74 is operative to fully open the interrupting valve 7 during the combustion effected by the regenerating burner to permit the resulting combustion gas to be introduced into the mixer 4 disposed downstream of the combustion gas through the now open exit and the interrupting valve housing 32 and to fully close the interrupting valve 7 when the combustion is not effected by the burner 3 with the result that the exhaust gas from the mixer 4 is prevented from reversely flowing into the regenerating burner 3.

Figure 3A:
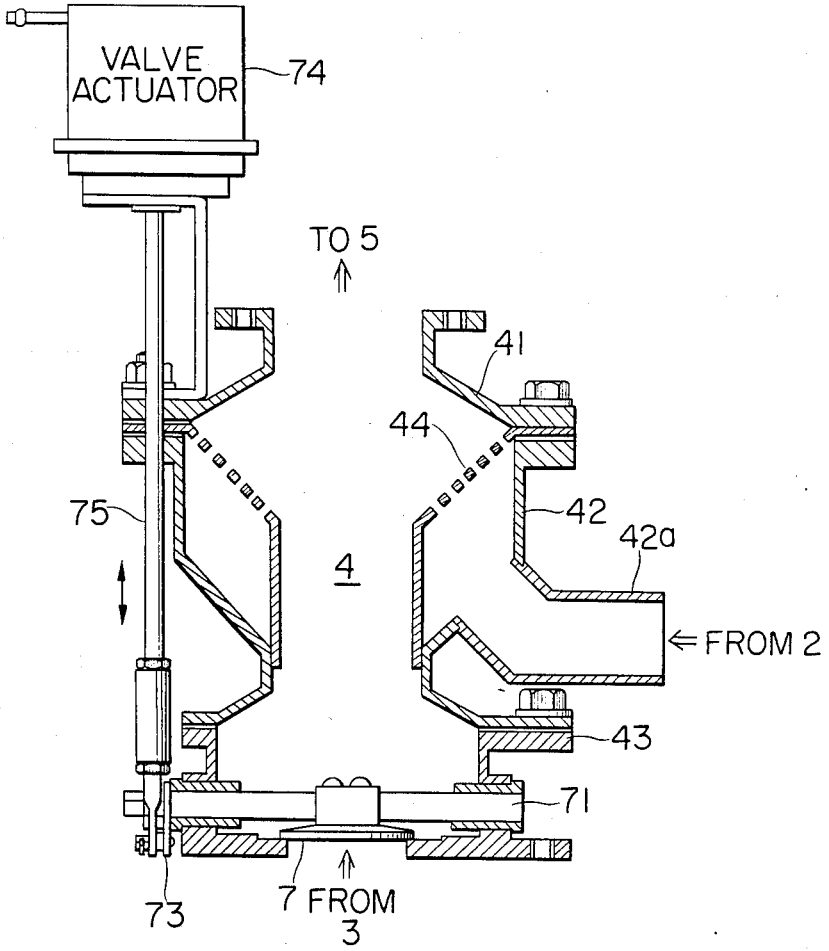
FIG. 3A is an elevational sectional view of the mixer, the interrupting valve and the interrupting control shown in FIG. 1 and connected together into an unitary structure with parts illustrated in elevation.

FIG. 3A is an elevational sectional view of a mixer unit of the particulate removing device of the present invention including the interrupting valve 7 as shown in FIG. 1 integrally assembled into the mixer 4 as shown in FIG. 1, with parts illustrated in elevation. In the arrangement illustrated, the mixer 4 comprises a mixing housing 41 including a perforated funnel-shaped section 44 having a flared end connected to a flared end of an inverted funnel-shaped section having a tubular portion connected to the filter housing 5 (see FIG. 1), and a gas introducing housing 42 including a hollow cylindrical section connected at one end, in this case the upper end as viewed in FIG. 3A, to the flared end of the perforated funnel-shaped section of the mixing housing 41, and a tapered hollow section connected at the lower end as viewed in FIG. 3A to a lower end of a tubular portion of the perforated funnel section of the mixing housing 41. The gas introducing housing 42 is integrally connected to an interrupting housing 43.

The gas introducing housing 42 is provided on the tapered section with a nipple 42*a* connected to the exhaust tube 2 (see FIG. 1) to introduce the exhaust gas flowing through the exhaust tube 2 to the interior of the gas introducing housing 42. The exhaust gas thus introduced is delivered to the interior of the mixing housing 41 through a multitude of perforations or holes regularly disposed on a flared portion of the perforated funnel-shaped section of the mixing housing 41.

Figure 3C:
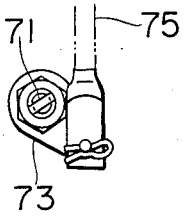
FIG. 3C is a perspective view in a somewhat enlarged scale of one part of the arrangement shown in FIG. 3A.
Figure 3B:
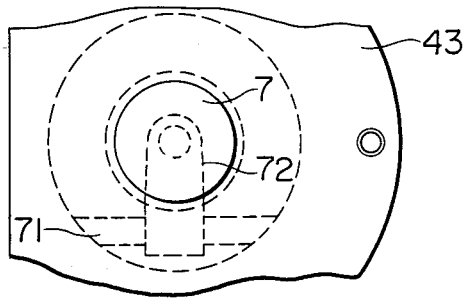
FIG. 3B is a fragmental bottom plane view of the arrangement shown in FIG. 3A.

The interrupting valve housing 43 includes a hollow cylindrical section connected to the tubular portion of the perforated funnel-shaped section of the mixing housing 31 through a tapered hollow section thereof and terminating at an apertured plate substantially identical to that shown in FIG. 2A. That plate is connected to a burner housing such as shown in FIG. 2A and includes a circular aperture for forming an exit for the combustion gas from the burner 3 (not shown) on the longitudinal axis of the mixing housing 41. In order to close and open the exit for the combustion gas, the interrupting valve 7 identical to that shown in FIG. 2A is provided in the same manner as described above in conjunction with FIGS. 2A and 2B excepting that the valve 7 is capable of contacting the upper side of the apertured plate. That is, the interrupting valve 7 is connected to a rotatable rod 71 identical to and supported in the same manner as that shown in FIG. 2A but above the apertured plate through a mounting plate 72 as shown in FIG. 3B similar that shown in FIG. 2B. The valve actuator 74 identical to that shown in FIG. 2A is operatively coupled to the rotatable rod 71 through the identical components as will readily be understood from a comparison of the illustration of FIGS. 2A and 2C and FIGS. 3A and 3C. In the arrangement of FIG. 3A, the valve actuator 74 is connected to the mixing housing 41 in the same manner as it would be connected to combustion housing 31 as described above in conjunction with FIG. 2A. Thus, it is seen in the arrangement shown in FIGS. 3A, 3B and 3C that the valve actuator 74 is similarly operated to rotate the interrupting valve 7 to an open and close the exit on the apertured plate resulting in the attainment of the same purposes as described above in conjunction with FIGS. 2A, 2B and 2C.

In summary, the present invention provides a simple structure including an interrupting valve integrally assembled into either one of a regenerating burner and a mixer whereby, when the regenerating burner is not used, an exhaust gas from a Diesel engine is prevented from partly entering a housing for the regenerating burner to cause particulates to adhering to an associated injection nozzle and the inner wall thereof thereby to clog the nozzle and cause the misfire of a mating ignition plug, while when the regenerating burner is used, a combustion gas therefrom is mixed with the exhaust gas to effectively regenerate the associated particulate filter.

While the present invention has been illustrated and described in conjunction with a few preferred embodiments thereof it is to be understood that numerous changes and modifications may be resorted to without departing from the spirit and scope of the present invention. For example, the exhaust tube 2 may be directly connected to the muffer 6 through a branch tube by passing the filter housing 5 and a change-over valve located at an inlet of the branch tube. In such an arrangement the change-over valve is responsive to the normal operation of the Diesel engine 1 to be put in its closed position to permit the exhaust gas to enter the mixer 4 and responsive to the regeneration of the particulate filter 5*a* to be put in its open position to permit the exhaust gas to directly enter the muffer 6 and cause only the combustion gas from the regenerating burner 3 to enter particulate filter 5*a* the mixer being omitted.

What is claimed is:

1. A device for removing particulates from a flow of exhaust has exhausted from a diesel engine before the flow of exhaust gas is exhausted to the outside atmosphere, comprising:

a particulate filter having a filter inlet;

a regenerative burner for producing combustion gas, having a burner outlet, said regenerating burner including a housing having a first closed end and a second open end and defining a combustion chamber therein, an injection nozzle disposed at said closed end to inject a fuel and air mixture into said combustion chamber, and an ignition plug disposed at said closed end to be adjacent to said injection nozzle;

means, including only one exhaust gas conduit connected to said filter inlet for directing the flow of exhaust gas thereto, for concurrently directing the flow of exhaust gas, and all of the combustion gas produced by said regenerating burner from said burner outlet into said filter through said exhaust gas conduit and said filter inlet, such that the combustion gas burns and removes particulates caught in said filter while said filter removes particulates from the flow of exhaust gas, and such that all of the flow of exhaust gas, and all of the combustion gas from said regenerating burner are directed through said filter before being exhausted to the outside atmosphere, said burner outlet being fluidly cummunicable with said filter only through said exhaust gas conduit;

means for controlling said regenerating burner, including means for turning said regenerating burner on and off;

an interrupting valve between said regenerating burner and said exhaust gas conduit, shiftable between an open position in which said regenerating burner and said exhaust gas conduit are in fluid communication and a closed position in which said interruption valve blocks fluid communication between said regenerating burner and said exhaust gas conduit and means for shifting said interrupting valve into said closed position when said regenerating burner is off, so as to prevent exhaust gas from passing through said interrupting valve into said regenerating burner.

2. A device for removing particulates as in claim 1, wherein said controlling means includes means for producing a control signal, said shifting means being responsive to said control signal.

3. A device for removing particulates as in claim 1, further comprising a mixer disposed in said exhaust gas conduit in fluid communication with and between said interrupting valve and said particulate filter to mix all of the combustion gas from said regenerating burner with the flow of exhaust gas from the diesel engine.

4. A device for removing particulates, as in claim 2, further comprising interrupting valve control means controlled with said control signal, and a valve actuator controlled by said interrupting valve control means to open and close said interrupting valve.

5. A device for removing particulates, as in claim 1, wherein said interrupting valve is disposed on said open end of said housing so as to open and close said combustion chamber.

6. A device for removing particulates, as in claim 3, wherein said burner outlet regenerating burner has an opening for directing combustion gas toward said mixer, and said mixer includes a mixing housing having one open end connected to said particulate filter and another end connected to said regenerating burner at said opening, said interrupting valve being disposed in said mixing housing so as to open and close said open end so as to respectively allow and block passage of the combustion gas into said mixing housing.

* * * * *